United States Patent [19]

Conover

[11] 4,235,450

[45] Nov. 25, 1980

[54] CATAMARAN BOAT DOLLIES

[76] Inventor: Clarence G. Conover, Rte. 1, Box 127-0, Ruskin, Fla. 33570

[21] Appl. No.: 876,643

[22] Filed: Feb. 10, 1978

[51] Int. Cl.[2] ..... B60P 3/10

[52] U.S. Cl. ..... 280/47.32; 9/1.2; 280/414 A

[58] Field of Search ..... 280/47.32, 47.13 B, 280/47.14, 414 A; 9/1.2; 244/101

[56] References Cited

U.S. PATENT DOCUMENTS

| | | | |
|---|---|---|---|
| 3,271,798 | 9/1966 | Zoretic | 280/414 A |
| 3,436,774 | 4/1969 | Schmitz | 9/1.2 |

*Primary Examiner*—John A. Pekar

*Attorney, Agent, or Firm*—Stein & Frijouf

[57] ABSTRACT

Catamaran boat dollies are provided, one for each of the hulls of a catamaran, for moving the catamaran along a beach or other supporting surface. Each dolly has a cradle mounted on a single wheel, the axis of the wheel axle declining outwardly from the cradle to define an included angle with the vertical of approximately 75°. Longitudinal bars of the cradle embrace opposite sides of the associated hull, and the disposition of the wheel and its axle results in a bending or rotational moment which causes the cradle to clampingly engage the hull. Because of the shape of a fourteen or sixteen foot "Hobie" type hull, the catamaran will remain in satisfactory engagement with the dollies as it is moved across the surface, but is preferably provided with a tie-down band for retaining the dolly in place as the catamaran is moved into or out of the water. For a "Sizzler" or "Prindle" type hull the cradle has opposed bars which engage opposite sides of a metal keel, and a tie-down band is provided for preventing the hulls from bouncing from between these bars. A protective coating such as polyvinyl-chloride preferably covers the cradle and other parts of the dolly to protect metal of the dolly and to protect the hulls from abrasion.

9 Claims, 5 Drawing Figures

FIG. 1
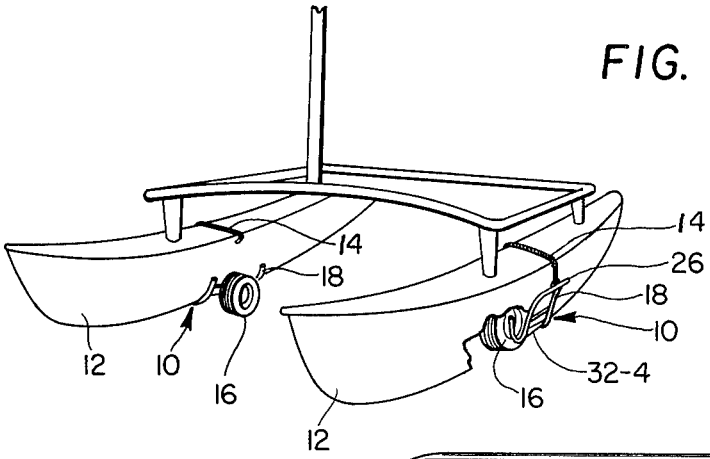
FIG. 3
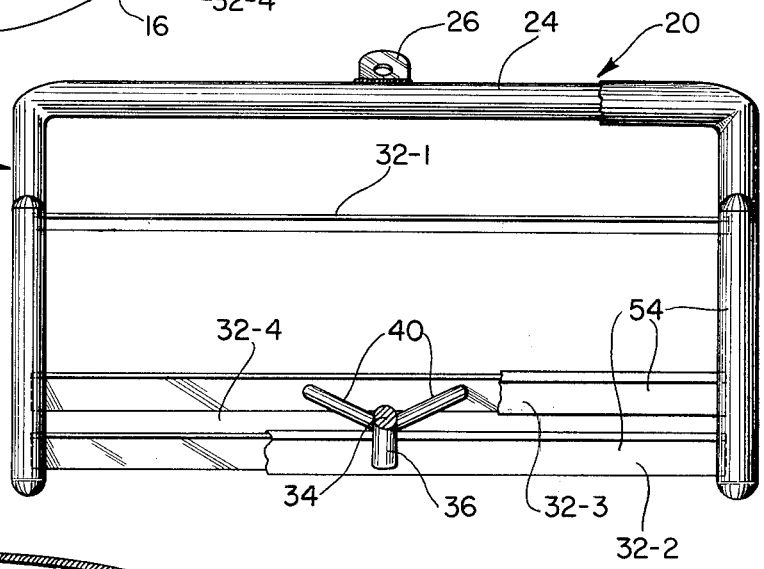
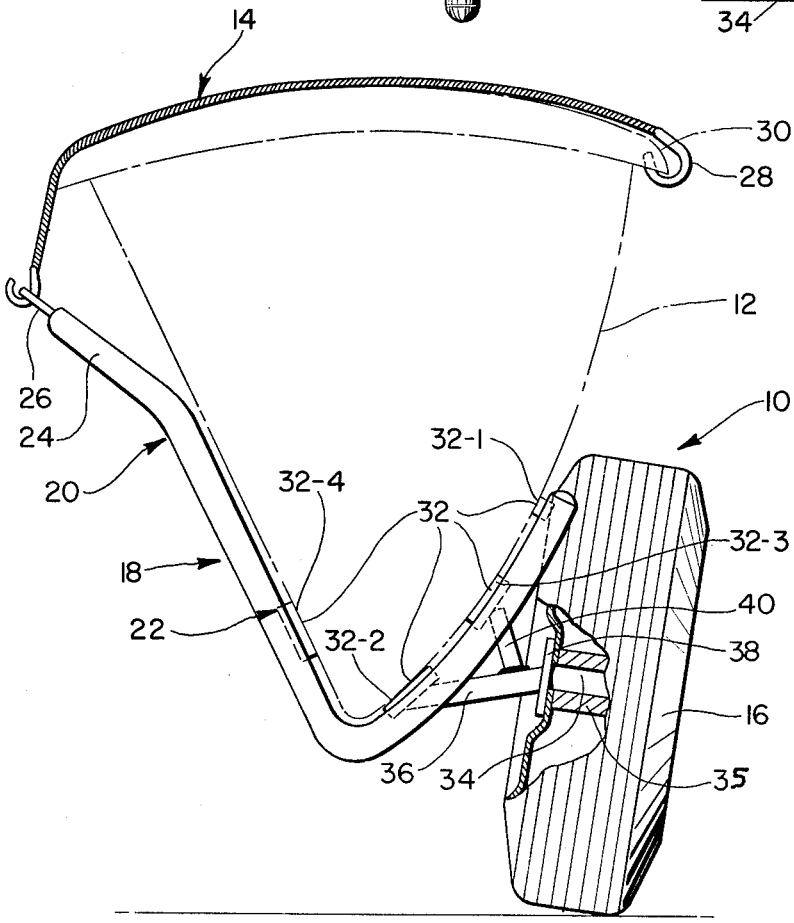
FIG. 2

CATAMARAN BOAT DOLLIES

This invention relates to boat dollies and, more particularly, to dollies for receiving the hulls of a catamaran.

BACKGROUND OF THE INVENTION

Because of the widely spaced apart hulls of a catamaran, the boat is rather difficult to maneuver manually on land. Various types of dollies and other apparatus has been proposed for this purpose. For example, in "Hobie Hot Line" magazine, published by Hot Line Publications, P.O. Box C-19509, Irvine, California 92713, Volume 5, Number 7, dated November-December 1976, carry advertisements of two types of such apparatus. On page 6, a pair of spheres are mounted on an axle having opposite outer ends which receive adjacent ones of the hulls, with the spheres between the hulls. On page 11, dollies, one for each of the catamaran hulls, are advertised; each dolly having a pair of wheels positioned on opposite sides of the associated hull when it is positioned in the dolly cradle which receives only the keel portion of the hull, so that the hull may bounce out of the cradle. Also, the two wheels of each dolly would make it somewhat heavy, and likely to roll in a truck or station wagon.

A pair of dollies for a catamaran are shown in FIG. 11 of U.S. Pat. No. 3,436,774, and are but briefly described in column 5, line 16 of this patent. The drawing shows each dolly having a pair of wheels, one on each of opposite sides of the associated hull, with the cradle embracing only the lower quarter of the hull.

A single wheel dolly for the bow of a canoe is shown in U.S. Pat. No. 1,109,520. U.S. Pat. No. 3,687,476, shows a one wheel dolly having a cradle which receives only the keel portion of a single hull boat.

A pair of single wheel dollies, one for each of opposite sides of a single hull boat are shown in U.S. Pat. No. 3,271,798, but each dolly engages but one side of the hull. Other dollies of a somewhat similar nature are shown in U.S. Pat. Nos. 2,578,376 and 2,637,567.

SUMMARY OF THE INVENTION

The invention, in brief, is directed to a dolly and, more particularly, to dollies, one for each of a pair of catamaran hulls. The dollies are intended for moving the catamaran on land, and each dolly is designed for clampingly engaging the associated hull. When the dollies are operatively positioned on the hulls, a single wheel of each dolly has the axis of its axle declining outwardly from a dolly cradle which receives the hull, and preferably declining to define an included angle of approximately 75° with the vertical. Tie-downs are preferably provided for securing the hull to its dolly, particularly when the catamaran is in the water.

It is an object of this invention to provide a new and useful dolly and, more particularly, such a dolly for supporting a hull of a catamaran boat to facilitate moving the catamaran into and out of the water and across dry land. A related object is to provide a dolly in which a hull receiving cradle of the dolly is automatically clampingly engaged with the hull through positioning of a single wheel of the dolly declining outwardly from the cradle to create a bending moment acting through the cradle on the hull.

A feature of the invention is provision of a tie-down on the dolly in order to retain the dolly on the hull when it is in the water, and to prevent the hull from bouncing in the cradle as the catamaran is moved across land.

BRIEF DESCRIPTION OF THE DRAWINGS

These and other objects and advantages of the invention will become apparent from the following description of preferred embodiments of the invention, and from the accompaning drawings.

BRIEF DESCRIPTION OF THE DRAWING

Figure 4:
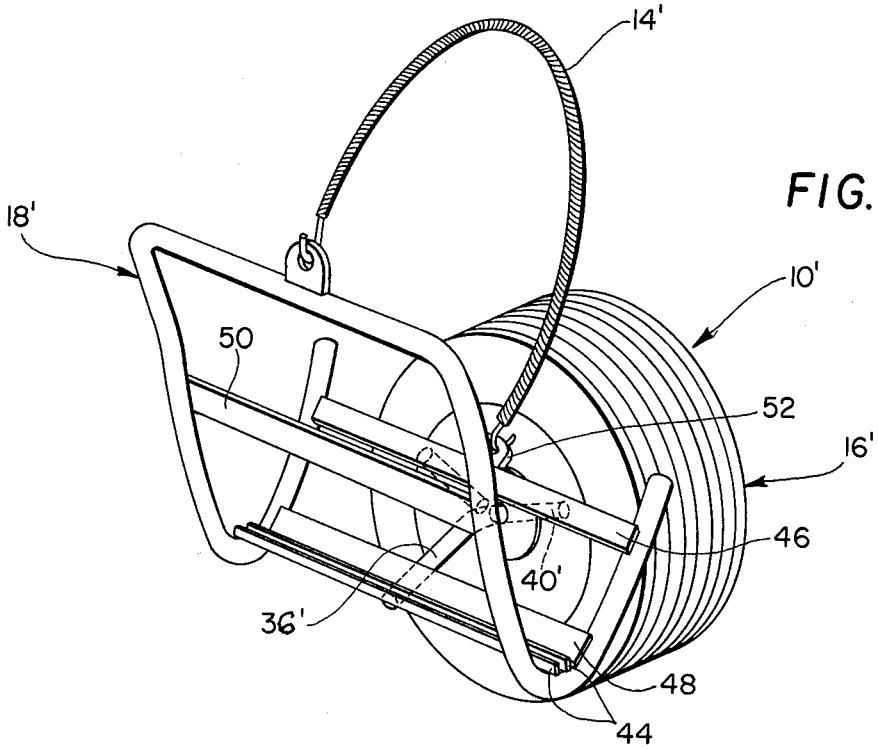
Figure 5:
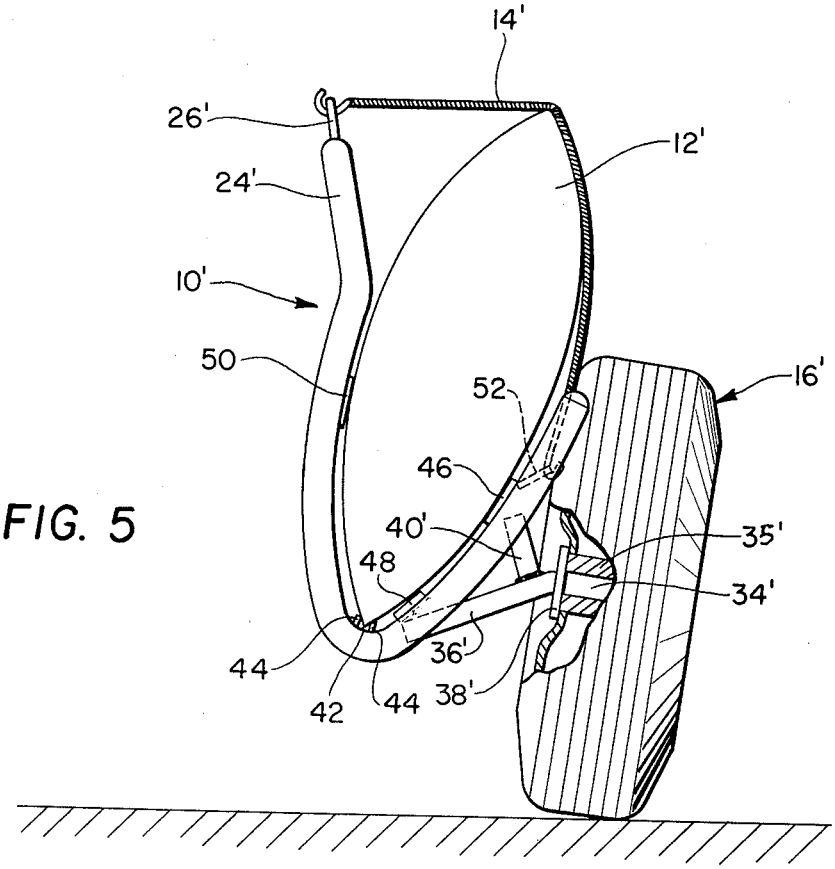

FIG. 1 is a schematic, fragmentary, perspective view looking toward the bow of a "Hobie" catamaran boat, each of the catamaran hulls being carried by a dolly, with one of the hulls being broken away to more fully illustrate the associated one of the dollies;

FIG. 2 is an enlarged, schematic elevational view of the dolly on the far hull in FIG. 1, with the hull illustrated in phantom lines, and as seen from the bow of the hull;

FIG. 3 is a schematic, side elevational view of the dolly illustrated in FIG. 2, as seen from the right side, but with a protective coating broken away, and a wheel removed and the wheel axle broken away, for clearer illustration;

FIG. 4 is a schematic, fragmentary perspective view of another embodiment of a dolly for a type of catamaran hull as is commonly provided on "Sizzler" and "Prindle" catamaran boats; and FIG. 5 is a schematic, end elevational view of the dolly illustrated in FIG. 4, with the hull illustrated in solid lines, and looking generally from the bow of the hull.

DESCRIPTION OF THE ILLUSTRATED EMBODIMENTS

Referring first to the embodiment illustrated in FIGS. 1-3, dollies 10 for use with the hulls 12 of a fourteen or sixteen foot long "Hobie" catamaran boat, are illustrated in FIG. 1 in normal operative position receiving an associated one of the two hulls 12 and secured thereto by tie-downs 14, and with each dolly wheel 16 positioned inwardly of the associated hull 12 so that the wheels 16 are opposed to and face each other.

Each dolly 10 includes a cradle 18, and in this embodiment the tie-down 14 is simply an added precaution when the dollies are used for moving the catamaran on dry land, but retain the dollies in place on the hulls as the catamaran is being launched and removed from the water. Each cradle 18 includes a base member 20, preferably cylindrical in cross-section as illustrated, the base member 20 having lower portions 22 at either end substantially conforming to the adjacent cross-sectional configuration of the hull 12. The lower portions 22 each have a free end adjacent the wheel 16 and merge into a U-shaped handle portion 24 directed slightly outwardly from the lower portions 22 so as to space the handle portion 24 from the outside of the associated hull 12. A rigid eye-bracket 26 is fixedly secured, as by welding, to the top center of the handle portion 24 for receiving the tie-down 14. The opposite end of the tie-down has a hook 28 normally received by an inner gunnel rail 30 of the hull 12. The hook 28 maybe suitably coated to avoid marring the rail 30.

The cradle lower portions 22 carry longitudinally extending, rigid bars 32, which preferably conform to any longitudinal curvature of the adjacent portions of the hull 12. The bars may be welded in place or secured by other suitable means. It should be noted that the bars 32 extend inwardly from the adjacent lower portions 22 of the cradle, so that the lower portions do not engage the hull 12. Bars 32 are preferably suitably coated to avoid marring the hull.

The wheel 16 is mounted on the cradle 18 in such a manner so as to assure the cradle being clamped to the hull. As herein illustrated, the clamping action is provided, at least in major part, by a wheel axle 34 which declines from the cradle when in normal operative position on the hull 12, so that the wheel 16 is tilted to position its lower portion farther under the cradle 18 and the hull 12, than its upper portion. As will be more fully discussed later, the unique arrangement of the wheel 16 and the longitudinally extending cradle bars 32 is such that an upper bar 32-1 adjacent the free ends of cradle lower portion 22 is urged into seated engagement with hull 12 while a lower bar 32-2 is urged away from the hull and an intermediate bar 32-3 is seated against the hull, but with less force that the upper bar 32-1. Bar 32-4, which is opposite the free ends of the cradle lower portions 22, is urged into snug seated engagement with the hull 12. Thus, the hull 12 is clamped between the bars 32-1, 32-3, and 32-4. The bar 32-2 initially receives the hull 12 as it is being operatively seated in the cradle 18. Bar 32-2 also provides a mounting for the inner end portion 36 of the axle 34.

When the catamaran is loaded on to the dollies 10, the weight of the catamaran and the offset wheel 16 causes a rotational or bending moment in a counterclockwise direction in FIG. 2. Accordingly, the hull 12 is clamped between bars 32-1 and 32-4 with moderate clamping occurring at 32-3. A similar but opposite rotation occurs for the other dolly 10 on the other catamaran hull 12. As illustrated in FIG. 2, the axle 34 receives a hub 35 of the wheel 16 with one end of the hub seated against a fixed abutment, in the form of a washer 38 welded to the axle 34. The other end of the hub 36 is retained in place on the axle 34 in any suitable manner, such as by a nut (not shown). Washer 38 is spaced from the aforesaid vertical axis so that the hub is laterally offset from this axis in a direction inwardly of the associated hull 12 (FIG. 1) and toward the other hull 12, thereby causing a bending or rotational moment which clamps the cradle 18 against the associated hull 12 as previously discussed. The longitudinal or rotational axis of the axle 34 declines from the aforesaid vertical axis of the cradle 18, preferably at an included angle of approximately 75° with this axis. This tends to force the wheel 16 against the washer and toward the cradle 18 as the catamaran and dollies are moved across a surface to maintain the clamping action of the cradle against the hull. The longitudinal axis of the axle 34 is also preferably normal to the longitudinal axis of the catamaran and hulls 12. By providing a single wheel 16 laterally offset from the cradle 18 for each dolly 10, rather than a wheel on either side of the dolly, a far more constant clamping action is maintained by the dolly against the hull. Braces 40 are provided between the axle inner end portion 36 and the bar 32-3.

In the embodiment illustrated in FIGS. 4 and 5, reference numerals primed, as 10', refer to similar or identical parts as those previously described with reference to the "Hobie" type dollies 10, and the parts will not necessarily be again described.

The dolly 10' illustrated in FIGS. 4 and 5 is designed for use with "Sizzler", "Prindle", or similar style hulls 12', these hulls 12' being generally elliptical in transverse cross-sectional configuration as illustrated in FIG. 5. Additionally, each hull 12' has a metal keel 42 extending lengthwise along the longitudinal axis of the hull. Keel 42 is received between spaced apart bars 44 which extend longitudinally of the cradle and retain the keel against rotational movement transversely of the cradle 18'. A clamping action of the cradle 18' against the hull 12' is generally similar to that previously described with reference to the embodiment of FIGS. 1-3. However, in the present embodiment of FIGS. 4 and 5 clamping occurs by reason of an inward force of an upper bar 46 extending between the free ends of the cradle 18' and the clamping action of the keel 42 against the bar 44 of the cradle. A bar 48 extending between and at a lower portion of the free ends of the cradle, and a bar 50 extending between and intermediate the handle portion 24' of the cradle provide guides for the hull as it is seated in or removed from the cradle. A tie-down 14' is secured to the bracket 26' with the opposite end secured to a bracket 52 fixed to the bar 46. This end may be optionally tethered to the hull 12' to aid in retaining the hull in its operative position in the cradle during movement across a surface as well when the hull is in water. Disposition of the wheel 16' and the axle 34' is substantially the same as described with reference to the prior embodiment.

In both embodiments, the entire cradle, other than the portion of the axle 34 or 34' which receives the wheel hub, is preferably coated with a polyvinyl chloride (PVC) coating 54' (FIG. 3 only, broken away) for preventing oxidation on the metal and providing a resilient and high friction surface for receiving the hull.

While this invention has been described and illustrated with reference to particular embodiments in a particular environment, various changes may become apparent to one skilled in the art, and the invention is therefore not to be limited to such embodiments or environment except as set forth in the appended claims.

What is claimed is:

1. A catamaran boat dolly for a hull of the catamaran, the dolly comprising cradle means for receiving opposite sides of the hull; wheel means for supporting said cradle means on a supporting surface, and means mounting said cradle means on said wheel means for creating a bending moment urging said cradle means into clamping engagement with opposite sides of the hull.

2. A catamaran boat dolly as set forth in claim 1 in which said wheel means has a hub, and said mounting means mounts said cradle means on said wheel means with said hub laterally offset in one direction from a vertical axis extending through said cradle means for causing said bending moment normally urging said cradle means into said clamping engagement with the hull.

3. A catamaran boat dolly as set forth in claim 2 in which the rotational axis of said hub declines from said vertical axis of said cradle means.

4. A catamaran boat dolly as set forth in claim 3 in which said rotational axis declines from said vertical axis at an included angle therebetween of about 75°.

5. A catamaran boat dolly as set forth in claim 1 in which said cradle means has opposite cradle sides, one for each of the opposite sides of the hull, and the mounting means mounts said cradle means on said wheel means for causing said bending moment normally urging said cradle means into said clamping engagement with the hull by forcing a limited upper portion of one of said cradle sides into firm seated engagement with a relatively upper portion of the adjacent hull side, and for forcing a limited lower portion of the other of said cradle sides into firm seated engagement with a relatively lower portion of the adjacent other hull side.

6. A catamaran boat dolly as set forth in claim 5 in which said wheel means has a hub, and said mounting means mounts said cradle means on said wheel means with said hub laterally offset in one direction from a vertical axis extending through said cradle means; and the rotational axis of said hub being generally normal to a longitudinal axis extending through said cradle means and declining from said vertical axis of said cradle means to define an included angle of about 75° between said axes.

7. A catamaran boat dolly as set forth in claim 6 in which said cradle means is a rigid cradle and the limited upper and lower portions thereof are bars extending generally longitudinally of said cradle, said wheel means is a single wheel, and including tie-down means for releasably securing the hull in said cradle.

8. A catamaran boat dolly for a hull of the catamaran, the dolly comprising a rigid cradle means for receiving opposite sides of the hull with the center of gravity of the hull being substantially coincident with a vertical axis of said cradle means, wheel means for supporting said cradle means on a supporting surface, and means for mounting said cradle means on said wheel means with said wheel means being laterally offset from said vertical axis of said cradle means for causing a rotational movement of said cradle means to clampingly engage opposite sides of the hull.

9. A catamaran boat transportation system, comprising in combination:

a first and a second dolly for a first and a second catamaran hull respectively;

said first and second dollies comprising a first and second rigid cradle means for receiving opposite side of the first and second catamaran hull respectively;

a first and a second wheel for respectively supporting said first and second cradle means;

means for mounting said first and second wheels to said first and second cradle means to be disposed on one side of each of the first and second catamaran hulls creating rotational moments in said first and second cradle means enabling said first and second cradle means to clamp engage opposite sides of the first and second catamaran hulls respectively.

* * * * *